US009003938B2

(12) United States Patent
Long et al.

(10) Patent No.: US 9,003,938 B2
(45) Date of Patent: Apr. 14, 2015

(54) DIVIDER FIN ASSEMBLY FOR DIE-CUT BLANKS

(75) Inventors: Michael G. Long, Conway, AR (US); Billy G. Turney, Jr., Guy, AR (US)

(73) Assignee: International Paper Company, Memphis, TN (US)

( * ) Notice: Subject to any disclaimer, the term of this patent is extended or adjusted under 35 U.S.C. 154(b) by 422 days.

(21) Appl. No.: 13/495,072

(22) Filed: Jun. 13, 2012

(65) Prior Publication Data

US 2013/0333538 A1 Dec. 19, 2013

(51) Int. Cl.

| | |
|---|---|
| ***B26D 7/06*** | (2006.01) |
| ***B26F 1/38*** | (2006.01) |
| ***B31B 1/00*** | (2006.01) |

(52) U.S. Cl.

CPC ... *B26D 7/06* (2013.01); *B26F 1/38* (2013.01); *B31B 1/00* (2013.01); *B31B 2201/0252* (2013.01); *B31B 2201/141* (2013.01); *B31B 2201/147* (2013.01); *B31B 2203/066* (2013.01); *B31B 2203/082* (2013.01)

(58) Field of Classification Search

CPC ..... B26D 7/06; B26F 1/38; B31B 2203/066; B31B 2201/141; B31B 2201/147; B31B 2203/082; B27G 19/08; B27G 19/02

USPC ..... 83/102, 102.1, 698.11, 827, 823, 83/DIG. 1, 477.2, 440.2, 478, 544; 403/409.1, DIG. 8, DIG. 12; 30/371, 30/373; 144/253.1

See application file for complete search history.

(56) References Cited

U.S. PATENT DOCUMENTS

| | | | | |
|---|---|---|---|---|
| 2,256,927 | A * | 9/1941 | Pittman | 83/102 |
| 3,645,304 | A * | 2/1972 | Thrasher | 83/821 |
| 6,170,370 | B1 * | 1/2001 | Sommerville | 83/102.1 |
| 7,293,488 | B2 * | 11/2007 | Wang | 83/102.1 |
| 2005/0211034 | A1 * | 9/2005 | Sasaki et al. | 83/102.1 |

* cited by examiner

*Primary Examiner* — Ghassem Alie
(74) *Attorney, Agent, or Firm* — Matthew M. Eslami

(57) ABSTRACT

A fin assembly for attachment to a die cutting machine to guide and align at least two blanks cut from a sheet in the machine as the blanks are fed through the machine. The fin assembly includes at least one thin plate-like fin having length and height dimensions and a narrow thickness. The fin is mounted in the machine so that the length dimension is in substantial alignment with a respective cut separating two blanks cut in the machine, so that the blanks fall on opposite sides of the fin as they are fed through the machine, whereby the fin keeps the blanks separate and aligns them as they are fed through the machine. At least one back stop is associated with the fin to prevent blanks from moving in a reverse direction and falling out of the machine when they fall past the fin.

12 Claims, 10 Drawing Sheets

DIVIDER FIN ASSEMBLY FOR DIE-CUT BLANKS

FIELD OF THE INVENTION

This invention relates to die-cutting machines, and more specifically to a fin assembly for attachment to a die-cutting machine to divide and align panels cut from a sheet of material in the die-cutting machine.

BACKGROUND OF THE INVENTION

Different colors and graphics are frequently printed on a large sheet of paperboard material to form an array of panel blanks containing the desired color scheme, graphics, logos, and other information. The sheet is then fed into a die cutter having cutting dies with a matching array of rows and/or columns to stamp or cut out the individual blanks. The blanks are then stacked for further processing.

To temporarily hold the cut blanks together and enable them to be stacked in appropriate alignment as they are fed from the die cutter for subsequent handling and processing, and to prevent bleeding of ink and/or the formation of dark bands at the edges of the graphics between adjacent blanks, narrow strips of the sheet material, known as gutters, are left between adjacent blanks. These gutter strips are treated as waste, and in accordance with conventional practice are removed by hand after the cut blanks leave the guillotine section of the die cutter. Hand removal of the gutter strips leads to repetitive motion injuries and significant slowing of the die cutter run speed.

Accordingly, it would be desirable to have a means that eliminates the need for hand removal of the gutter strips.

SUMMARY OF THE INVENTION

The present invention comprises a fin assembly for attachment to a die cutting machine to guide and align at least two blanks as the blanks are fed through the machine, wherein the blanks as cut from a sheet in the machine are devoid of gutters. The fin assembly comprises at least one thin plate-like fin having length and height dimensions and a narrow thickness. Means are provided for mounting said at least one fin in the die cutting machine in a position so that the length dimension of the fin is in substantial alignment with the cut separating the blanks so that the blanks fall on opposite sides of the fin as they are fed through the machine, whereby the fin keeps the blanks separated and in proper alignment.

In particular, the fin assembly of the invention is mounted in the guillotine section of the machine and maintains the blanks separated and in proper alignment as they fall into the gate section.

In a preferred construction the fin assembly comprises a mounting bar adapted to be attached to the frame of the die cutter in the guillotine section so as to extend horizontally and transversely of the die cutter, with one or more vertical fins and backstops attached to the mounting bar for adjustment along its length. In one embodiment the backstops are attached to and extend at a right angle from the fins, and in another embodiment the backstops are separately attached to the mounting bar. The number of fins used depends upon the number of blanks being cut from the sheet. Thus, if a single cut is being made to form two panel blanks, a single fin can be positioned in alignment with the cut between the blanks. If two cuts are being made to form three blanks, then two fins would be attached to the mounting bar with one fin in alignment with each cut, and so forth up to any number of fins to accommodate the number of cuts and panel blanks being made.

The fin assembly of the invention allows the die cut blanks to run though the die cutter without the need for gutter tabs, thereby eliminating the exposure to injuries from hand removal of gutter tabs and allowing much higher die cutter run speed. The invention allows the user to separate and square blanks for bundling or transfer to another machine, and on a pilot run use of the fin assembly eliminated the need for hand removal of 500,000 tabs and finished the job in three shifts whereas it would have taken six to nine shifts to complete with conventional equipment not having the fin assembly of the invention.

The fin assembly can be used in any converting plant running multiple-out die-cut blanks on flatbed die cutters and can be set up as a rail system or as individual fin assemblies on multiple flat bed die cutting equipment with gate and belt delivery systems. The height, depth and width of the assembly is adapted to the machine it is applied to.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE INVENTION

Figure 1:
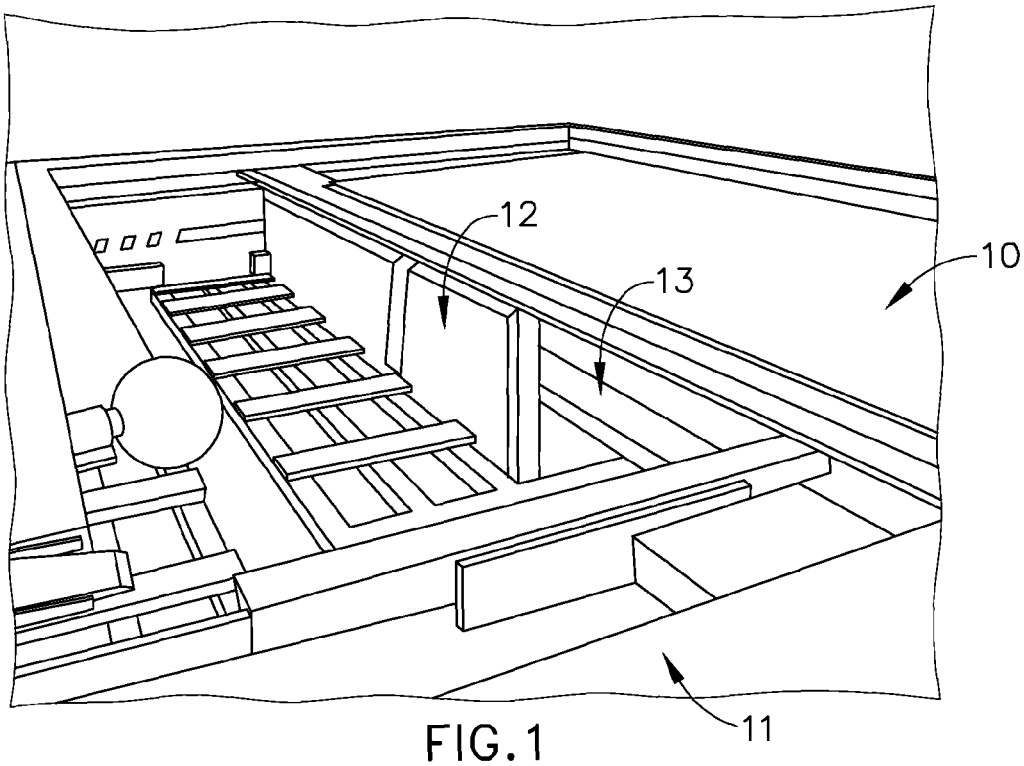
FIG.1 (PRIOR ART)
FIG. 1 is a fragmentary top isometric view of the guillotine and gate sections of a typical prior art die cutting machine of the type on which the fin assembly of the invention can be used.
Figure 2:
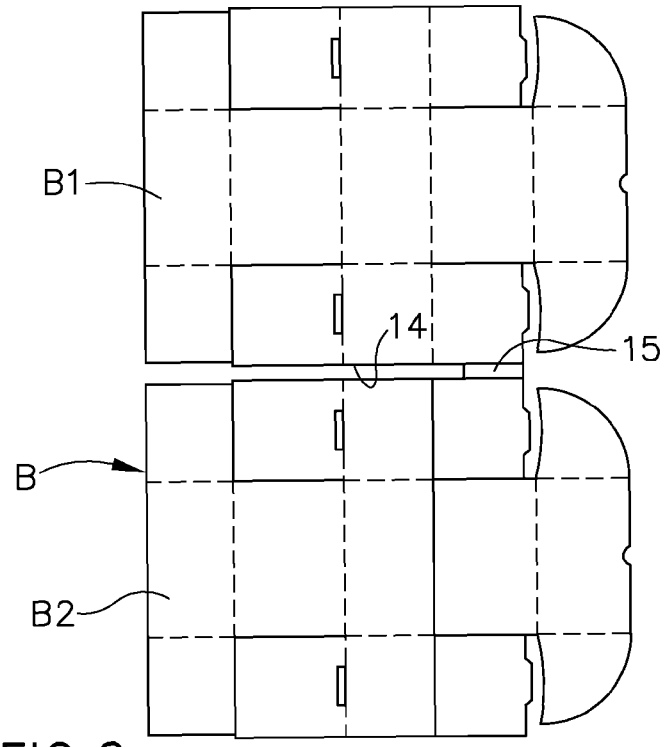
FIG.2 (PRIOR ART)
FIG. 2 is a plan view showing an example of a sheet of paperboard material that is cut to form two panel blanks, with a gutter tab interconnecting the two blanks in accordance with conventional practice.
Figure 3:
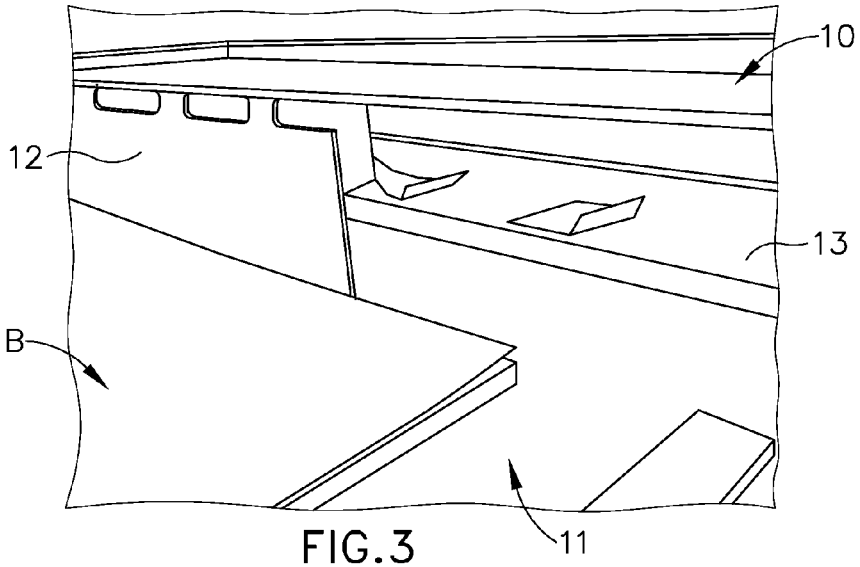
FIG.3 (PRIOR ART)
FIG. 3 is an enlarged fragmentary top isometric view of the guillotine and gate sections of a die cutter machine of FIG. 1, showing in better detail the machine frame member to which the fin assembly of the invention can be mounted.

The guillotine section 10 and gate section 11 of a conventional die cutting machine are shown generally in FIGS. 1 and 3. As seen best in FIG. 3, a conventional machine has a back stop 12 attached to the machine frame 13 to keep blanks B from falling out of the machine as they are fed from the guillotine section into the gate section, but when multiple blank panels B1 and B2 as shown in FIG. 2 are formed by a cut 14 extending across the blank sheet there is nothing to keep the blank panels from orienting haphazardly and overlapping as they fall onto the gate. Consequently, as shown in FIG. 2 a gutter tab 15 is left connected between the blank panels B1 and B2 to hold them in position relative to one another when they are die cut and fed into the gate section. Before subsequent processing of the blank panels can begin, these gutter tabs must be removed and they are currently removed by hand. This manual step exposes workers to repetitive motion injury and significantly slows down the die cutter run speed.

A first form of fin assembly devised by applicant to cure this shortcoming of conventional die cutting machines is shown at 20 in FIGS. 4-15. In this embodiment, the fin assembly comprises: an elongate mounting bar 30 that extends horizontally and transverse to the path of movement of blanks in the die cutting machine when the mounting bar is in operative position; at least one fin 40 mounted on the bar for adjustment along the length of the bar; at least one back stop 50 mounted on the bar for adjustment along the length of the bar; and a mounting bracket 60 attached to each of the opposite ends of the bar for mounting the assembly to the machine frame 13.

All of the components of the assembly are preferably made of aluminum, but any suitable material can be used. In a particular construction of the fin assembly according to the invention, each fin 40 is approximately 8 inches long from its back edge to its front edge as viewed in FIG. 4, for example, has an overall height of about 5½ inches, and a thickness of about ⅜ inch. The mounting bar 30 is about 48 inches long, has a width from its top edge to its bottom edge of about 1½ inches, and a thickness of about ½ inch. The back stops 50 have a length of about 5½ inches, a width of about 1½ inches, and a thickness of about ⅝ inch. The mounting brackets 60 have a length L of about 3½ inches, a width W of about 2½ inches, and a height H of about 1 inch. Although particular dimension for the assembly components have been given by way of example, it should be understood that the dimensions can be varied to suit the particular application.

Figure 4:
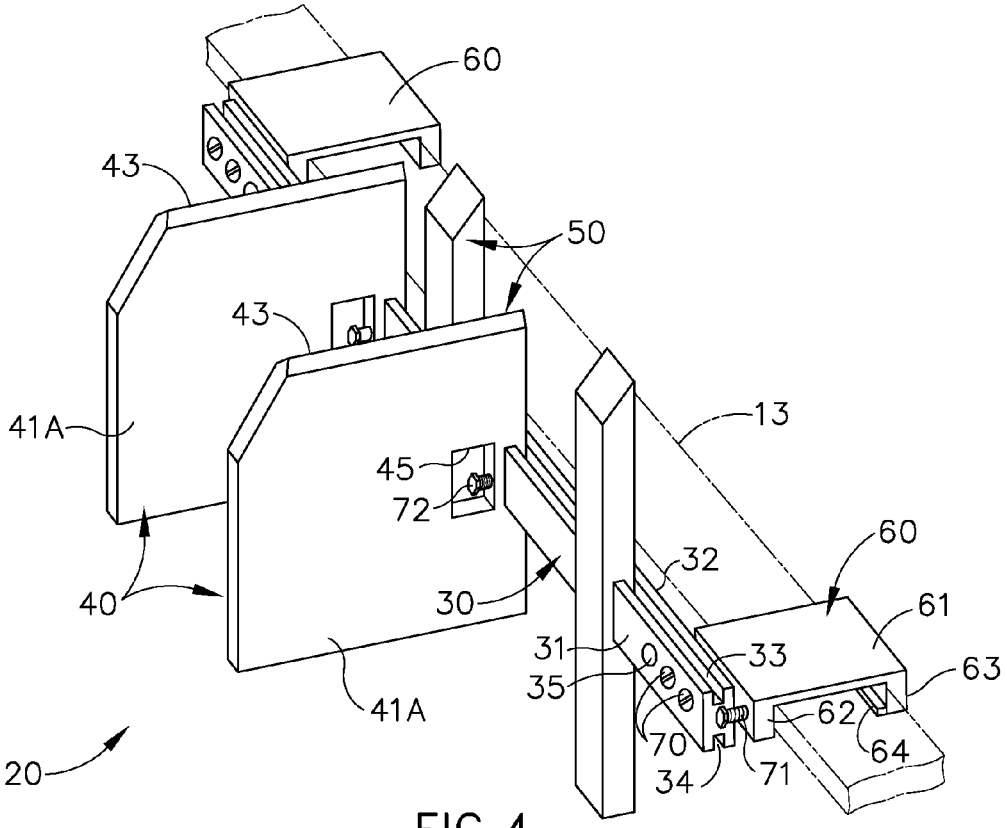
FIG. 4 is an isometric view of a first form of fin assembly according to the invention, wherein the fin assembly is adapted for use with the machine frame member of FIG. 3.
Figure 7:
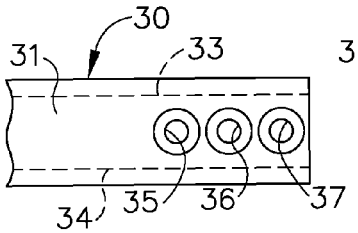
FIG. 7 is a fragmentary front view in elevation of one end of the mounting bar for the fin assembly of the invention.
Figure 8:
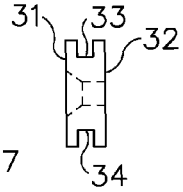
FIG. 8 is a sectional view of the mounting bar, taken along line 8-8 in FIG. 7.
Figure 9:
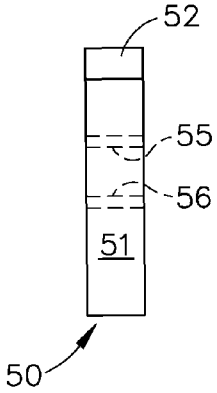
FIG. 9 is a front view in elevation of one of the backstops used in the fin assembly.
Figure 10:
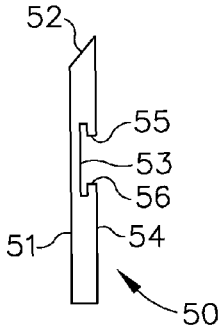
FIG. 10 is a view in section taken along line 10-10 in FIG. 9.
Figure 11:
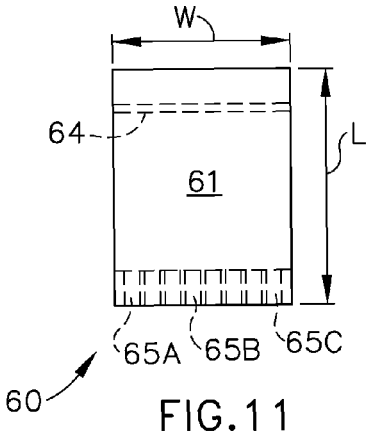
FIG. 11 is a top plan view of one of the mounting brackets for attaching the fin assembly to the machine frame member shown in FIG. 3.
Figure 12:
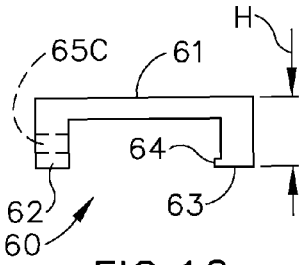
FIG. 12 is a side view in elevation of the bracket of FIG. 11.
Figure 13:
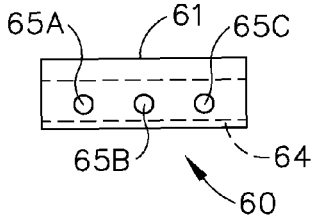
FIG. 13 is an end view of the bracket, looking toward the left hand side of FIG. 12.
Figure 14:
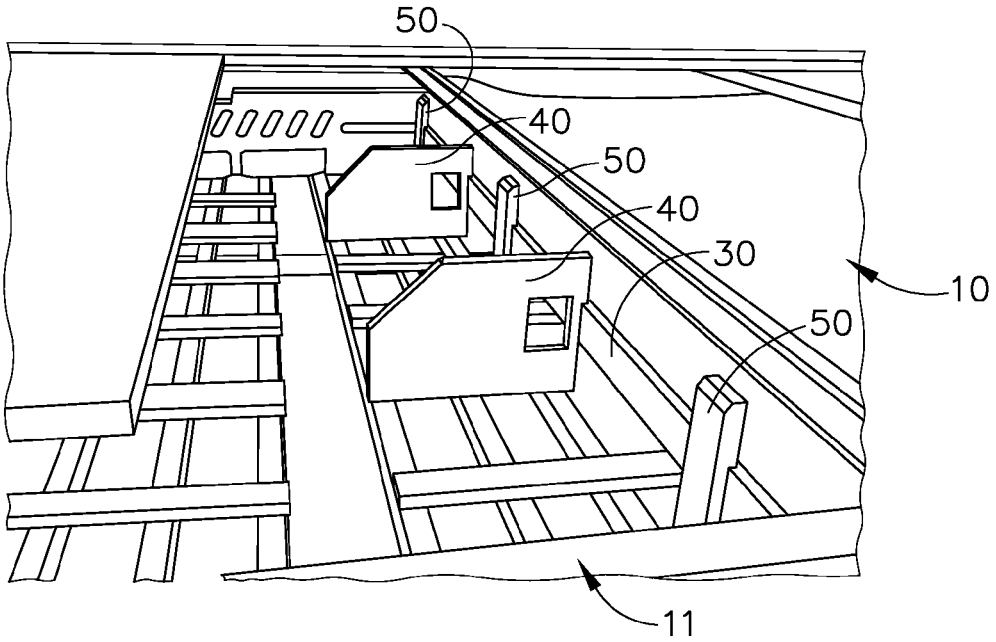
FIG. 14 is a fragmentary top isometric view showing a fin assembly having two fins and three backstops according to the invention mounted in a die cutter at the entrance side of the guillotine section.

As seen best in FIGS. 4, 7 and 8, the mounting bar 30 has planar front and back surfaces 31 and 32, channels 33 and 34 in its top and bottom edges, respectively, and three countersunk openings 35, 36 and 37 extending through each of its opposite ends.

Figure 5:
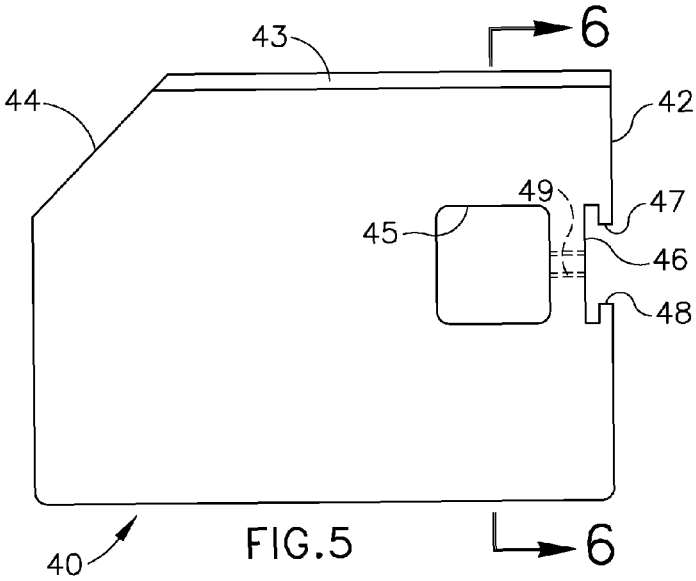
FIG. 5 is an enlarged side view in elevation of one of the fins in the assembly of FIG. 4.
Figure 6:
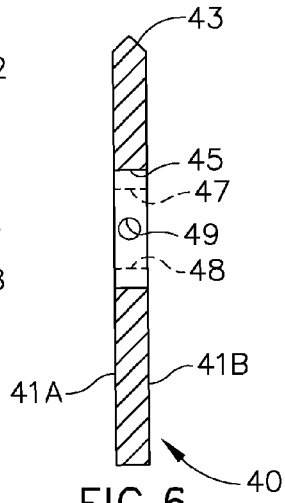
FIG. 6 is a view in section taken along line 6-6 in FIG. 5.

Each fin 40, as seen best in FIGS. 4, 5 and 6, is substantially rectangularly shaped, with opposite planar faces 41A and 41B, a back edge 42, a beveled or rounded top edge 43, and a cut-away upper outer corner 44. A generally rectangularly shaped cut-out 45 is made in the fin spaced a short distance from the back edge 42 and approximately midway between the top and bottom edges. A generally T-shaped cut-out 46 in the back edge in line with the cut-out 45 forms two opposed spaced apart projections or lips 47 and 48, and a hole 49 extends from the cut-out 45 into the cut-out 46 approximately midway between the projections 47 and 48.

The back stops 50 have a planar front face 51, a rearwardly sloping beveled top end 52, and a generally T-shaped cut-out 53 in the back face 54 approximately midway between the top and bottom ends of the back stop. The T-shaped cut-out defines two opposed spaced apart projections or lips 55 and 56.

Each mounting bracket 60 has a substantially rectangularly shaped top wall 61 with a front flange 62 depending from a front edge thereof and a back flange 63 depending from a back edge thereof. A lip 64 on the inner bottom edge of flange 63 is in opposed facing relation to flange 62, and a plurality of countersunk openings 65A, 65B and 65C extend through the front flange 62.

In use, the mounting brackets 60 are attached to the ends of the mounting bar 30 by extending fasteners 70 through the two outermost openings 36 and 37 in the mounting bar and into the first two openings 65A and 65B in the front flange 62 of the bracket, leaving exposed the third opening 65C in the mounting bracket. The fins 40 and back stops 50 are then slid onto the mounting bar, with the lips 47, 48 on the fins and the lips 55, 56 on the back stops slidably engaged in the channels 33 and 34 in the top and bottom edges of the mounting bar.

Figure 15:
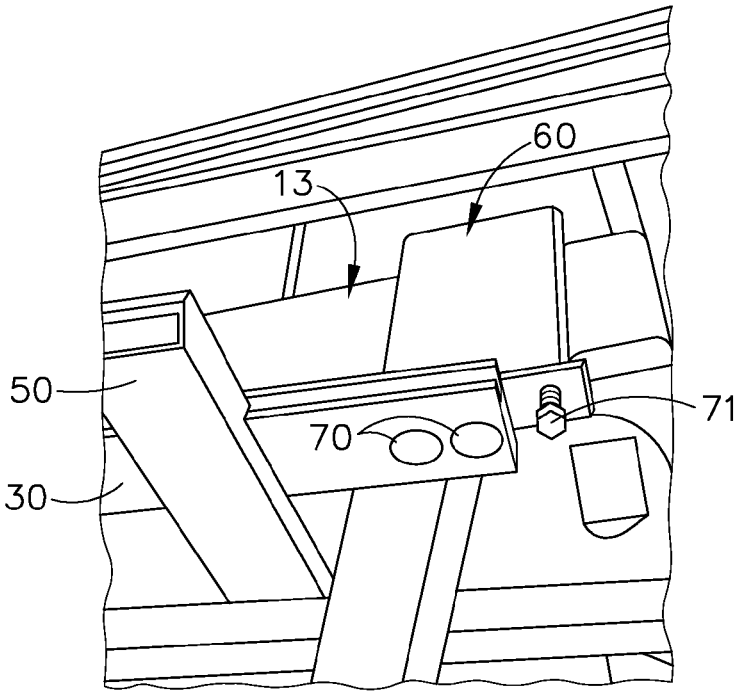
FIG. 15 is an enlarged fragmentary top isometric view of one end of the assembly of FIG. 14, showing details of the mounting structure for attaching the fin assembly to the frame member of the die cutter.

The mounting brackets are then mounted to the machine frame member 13 by engaging the lip 64 on the bottom end of flange 63 beneath the back edge of the frame member and pivoting the mounting brackets and attached fin and back stop assembly down to the position shown best in FIGS. 4 and 15. When the mounting brackets are positioned as desired on the frame member 13, a set screw 71 is extended through the third opening 65C in the mounting bracket and into engagement with the edge of the frame member 13 to secure the mounting bracket and attached fin assembly to the frame member.

Figure 16:
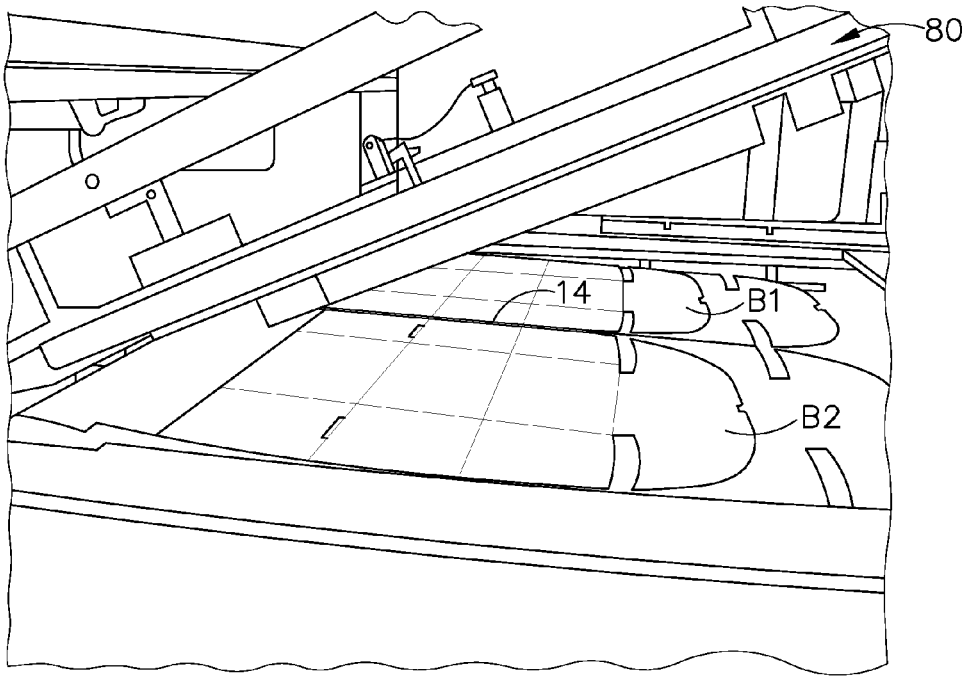
FIG. 16 is a fragmentary top isometric view showing a sheet cut to form two panel blanks as in the prior art arrangement of FIG. 2, but devoid of a gutter tab in accordance with the present invention.

The fins 40 are then slid along the length of the mounting bar 30 so that they are in alignment with the locations of the cut or cuts 14 dividing the sheet into the number of blanks (e.g. B1 and B2 as shown in FIG. 16) being cut in the die cutter and then secured in position by extending a set screw 72 through the respective openings 49 and into engagement with the front face of the mounting bar 30. As the blanks (e.g. B1 and B2) exit the guillotine section and drop into the gate section the fins keep them aligned so that they are neatly stacked and ready for further processing.

The back stops 50 are then slid into positions adjacent the fins to engage the trailing edge of blanks exiting the guillotine section and dropping into the gate section to prevent the blanks from falling out of the machine.

The tapered upper edges of the fins and back stops facilitate movement of the blanks downwardly past them and prevent hang-up of the blanks on the upper edges of these structures.

Figure 17:
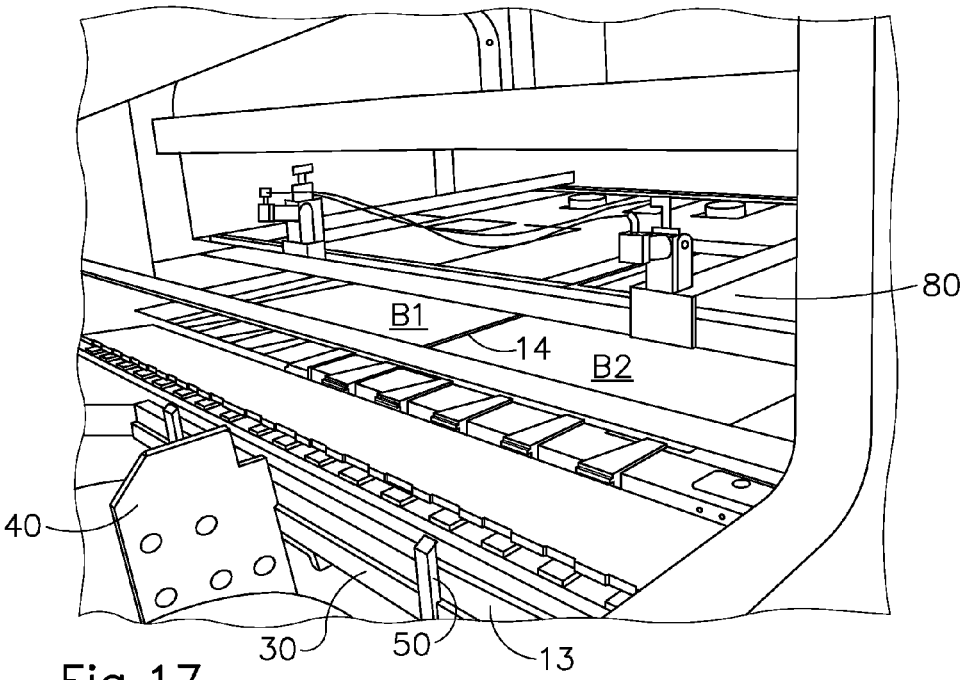
FIG. 17 is fragmentary isometric view looking toward the entrance of the guillotine section of a die cutter, with a fin assembly according to the invention mounted to the machine and having a single fin for use to divide two blanks as shown in FIG. 16.

It should be noted that in a die cutter equipped with the fin assembly of the invention the stripper 80 (see FIGS. 16 and 17) is appropriately modified so that it completely removes the gutters from the blanks B1 and B2, leaving them unattached to one another, i.e. the stripper is modified so that it does not leave a gutter tab 15 as shown in FIG. 2.

Figure 18:
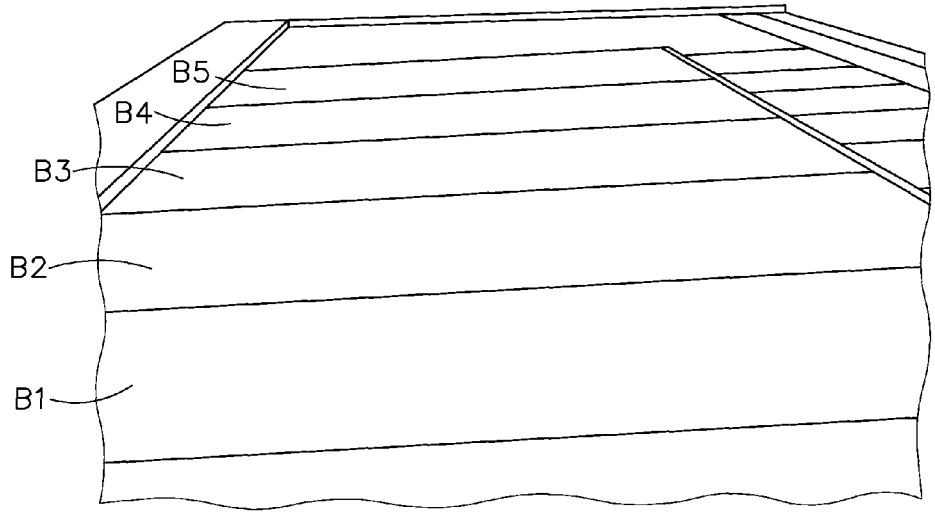
FIG. 18 is a fragmentary isometric view looking down into the guillotine and gate sections of a die cutter that is configured to make five cuts to form six panel blanks, wherein the blanks are shown just leaving the guillotine section and about to settle into the gate section.
Figure 19:
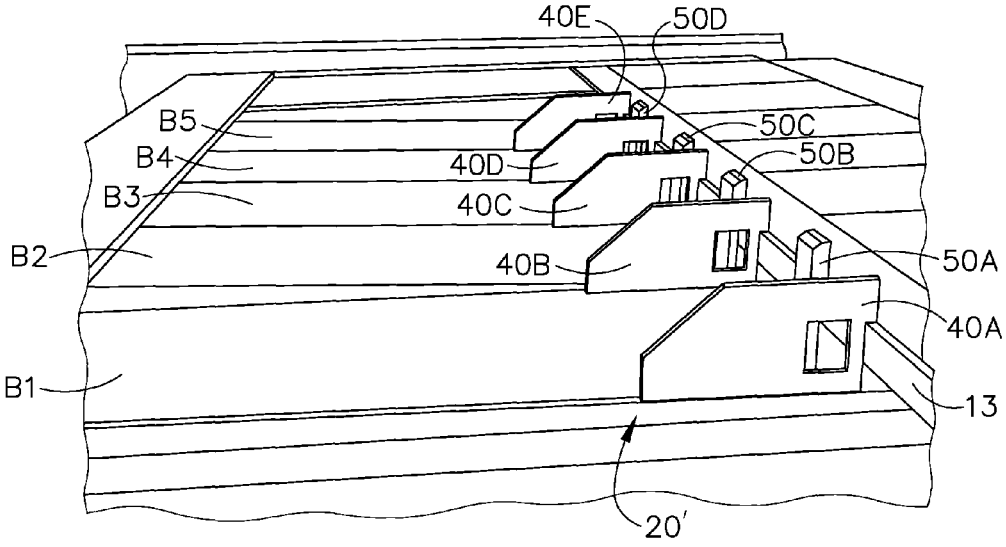
FIG. 19 shows the blanks of FIG. 18 being guided into aligned relationship on top of one another by an array of five fins in accordance with the present invention.

FIGS. 18 and 19 are somewhat schematic depictions of a die cutter set up to make five cuts to separate the sheet into five blanks B1, B2, B3, B4 and B5. The fin assembly 20' accordingly has five fins 40A, 40B, 40C, 40D and 40E in alignment with the respective cuts, and associated back stops 50A, 50B, 50C and 50D to properly guide and align the five blanks as they exit the guillotine section and drop into the gate section. In this regard, the fin assembly of the invention can have any number of fins positioned in any desired spacing, depending upon the blanks being cut in the machine.

Figure 20:
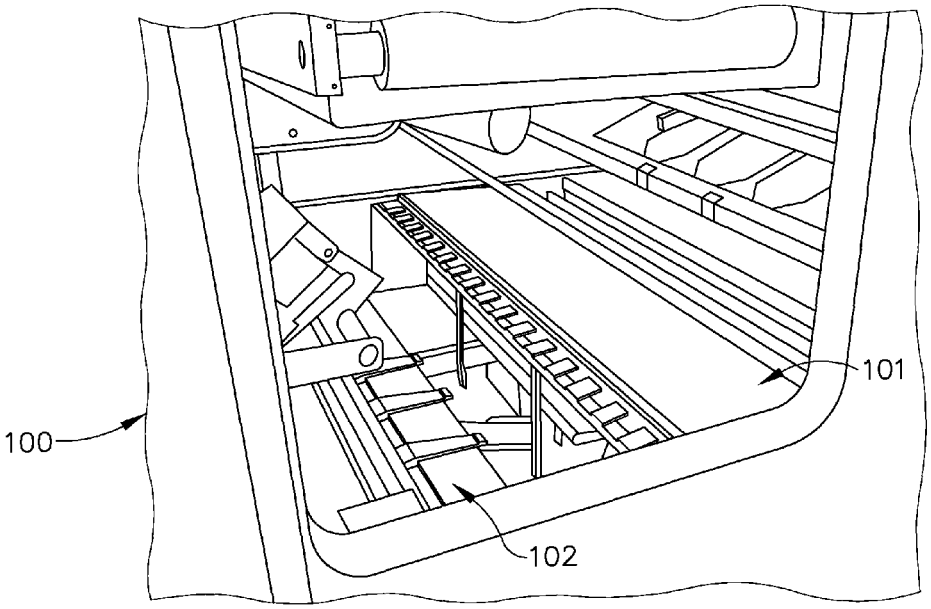
Fig.20 (PRIOR ART)
FIG. 20 is a fragmentary isometric view looking into the guillotine section of another type of conventional die cutter machine.
Figure 21:
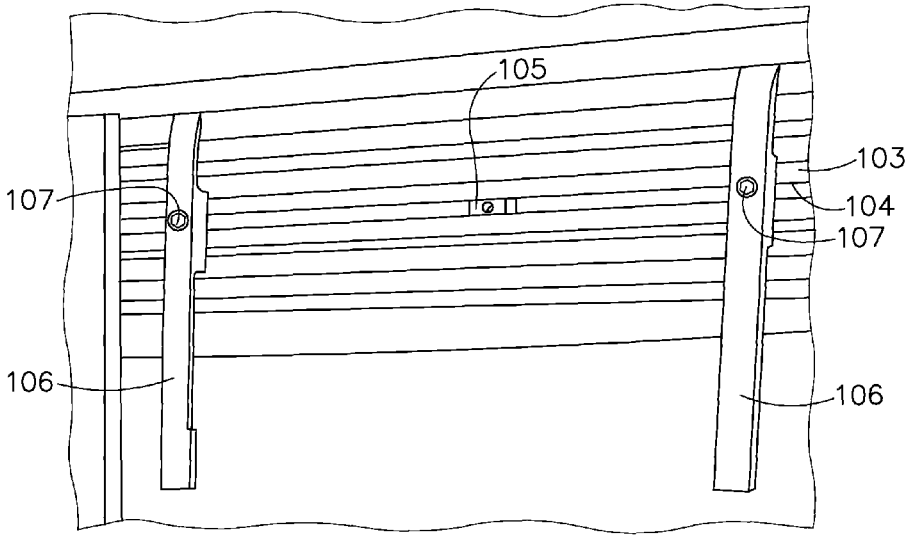
Fig.21 (PRIOR ART)
FIG. 21 is a greatly enlarged fragmentary view looking toward the machine frame member and backstops as conventionally used in the machine of FIG. 20.
Figure 22:
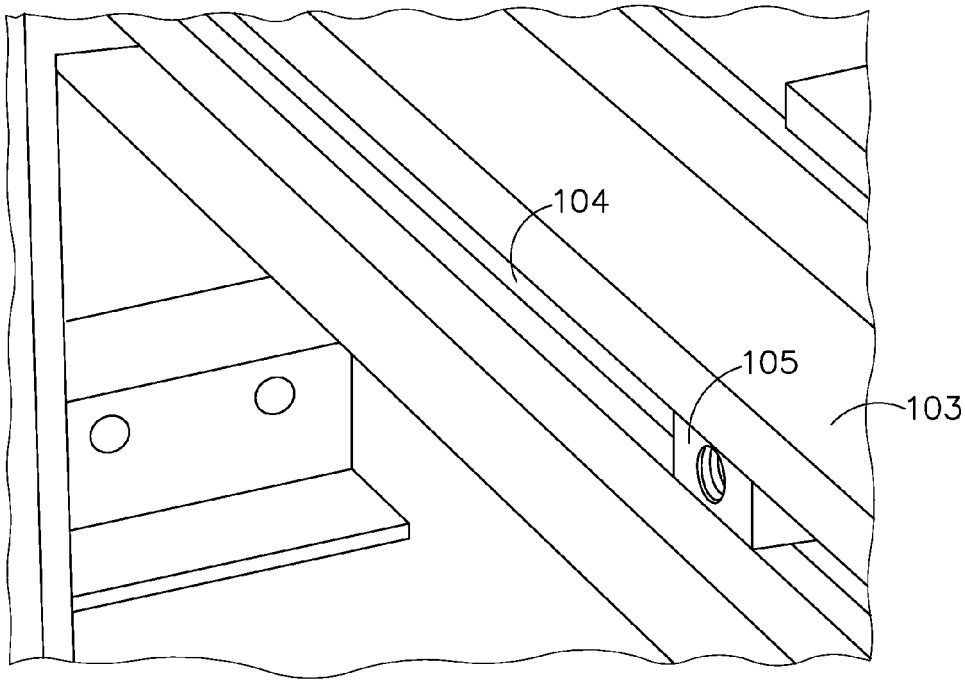
FIG. 22 is a further enlarged fragmentary top isometric view of the machine frame member and nuts conventionally used to attach the backstops shown in FIG. 21.

FIGS. 20 and 21 are fragmentary views of a different model conventional die cutting machine 100, showing the guillotine and gate sections 101 and 102, respectively. Rather than the generally flat horizontal frame member 13 as in the previous machine shown in FIGS. 1-15, machine 100 has a slotted frame member 103 with a forwardly facing slot 104 extending along its length, and hexagonal nuts 105 held in and slidable along the slot. Back stops 106 are adjustably positioned on the frame member 103 by extending fasteners 107 through the back stops and into the nuts 105. A greatly enlarged isometric view of the frame member 103 is shown in FIG. 22.

Figure 23:
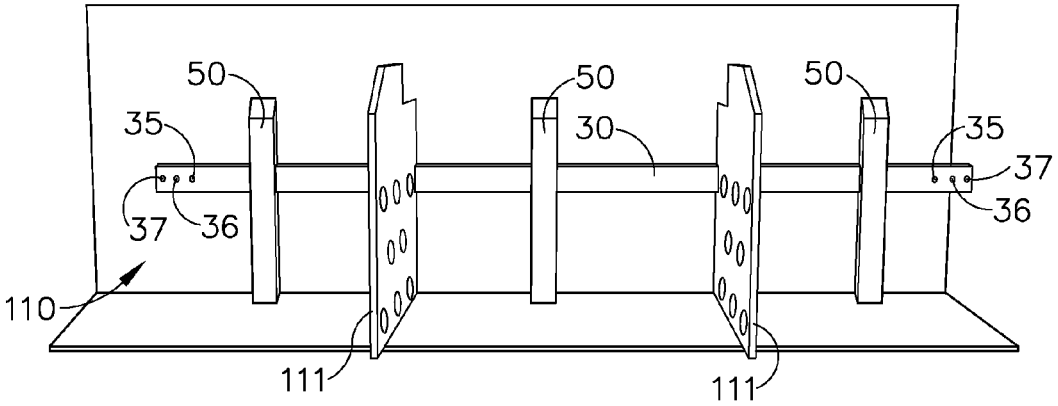
FIG. 23 is a front view of a second embodiment of fin assembly according to the invention, wherein the fin assembly is adapted for mounting to the machine frame member of FIG. 22.
Figure 24:
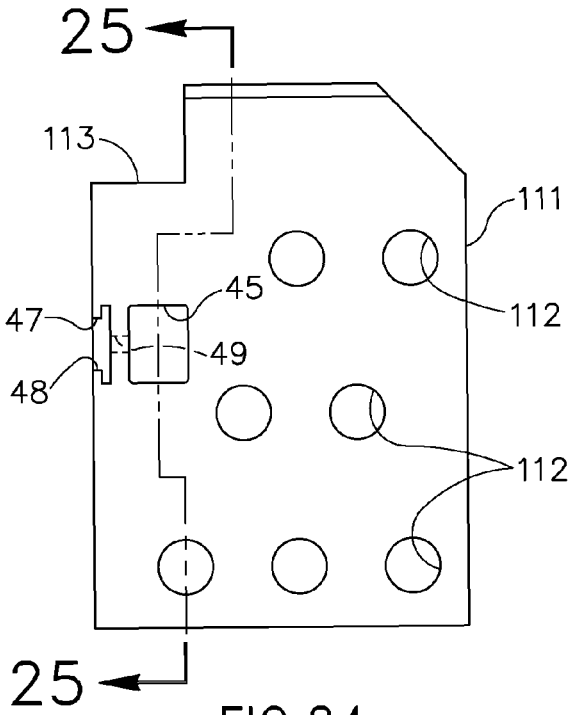
FIG. 24 is a side view in elevation of one of the fins in the assembly of FIG. 23.
Figure 25:
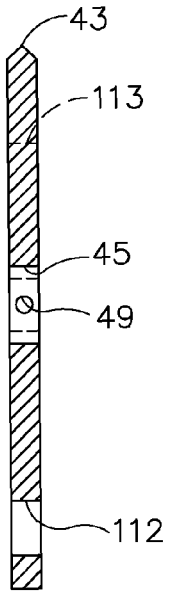
FIG. 25 is a view in section taken along line 25-25 in FIG. 24.

A slightly modified fin assembly is shown at 110 in FIG. 23. This form of fin assembly is substantially the same as the previous fin assembly 20, except that the mounting brackets 60 are omitted, the fins 111 have a plurality of openings 112 through them, and a notch 113 is in the upper rear corner of the fins. The openings 112 comprise vents for escape of air as the blanks drop past the fins, and the notch 113 provides clearance between the fins and adjacent machine parts in the machine 100.

Figure 26:
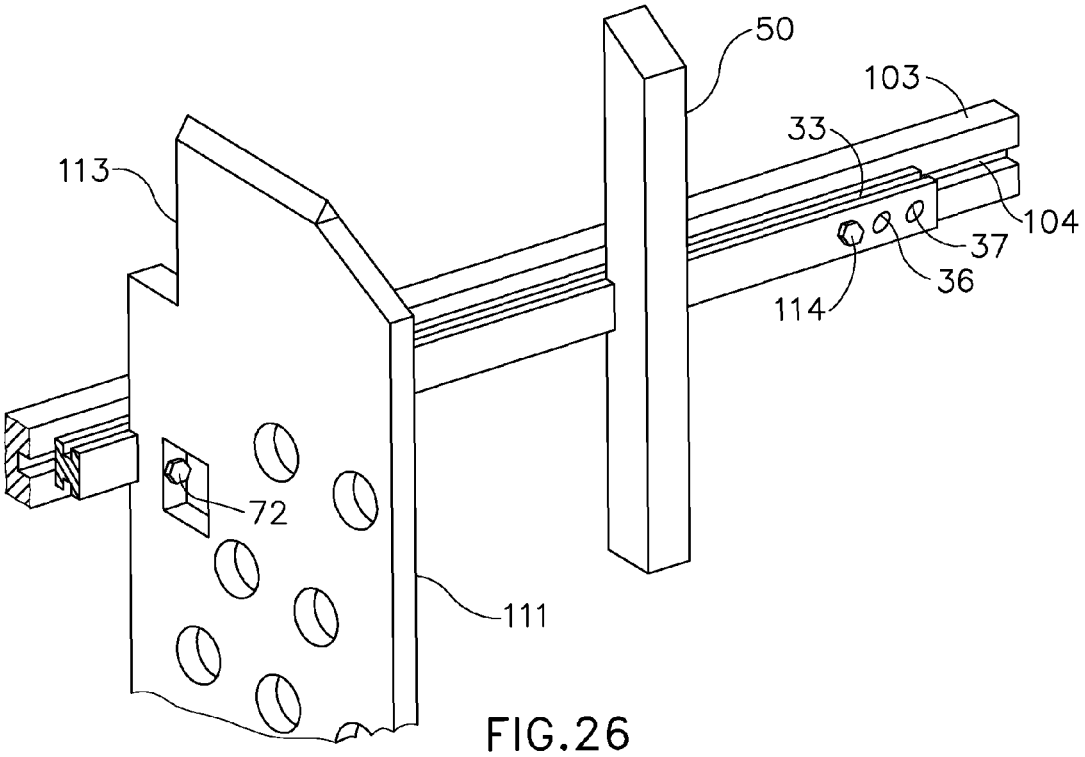
FIG. 26 is a somewhat schematic fragmentary isometric view of the fin assembly of FIG. 23 mounted to the machine frame bar shown in FIGS. 22 and 23.

The fins 111 and back stops 50 are assembled to the mounting bar 30 in the same way as in the previous embodiment and are not further described in connection with this form of the invention. However, as seen best in FIG. 26, the mounting bar 30 is attached to the machine frame member 103 by extending fasteners 114 through one of the openings 35, 36 or 37 in the ends of the mounting bar and into respective adjacent nuts 105 in the slotted frame member 103 rather than through the intermediary of a mounting bracket 60.

Figure 27:
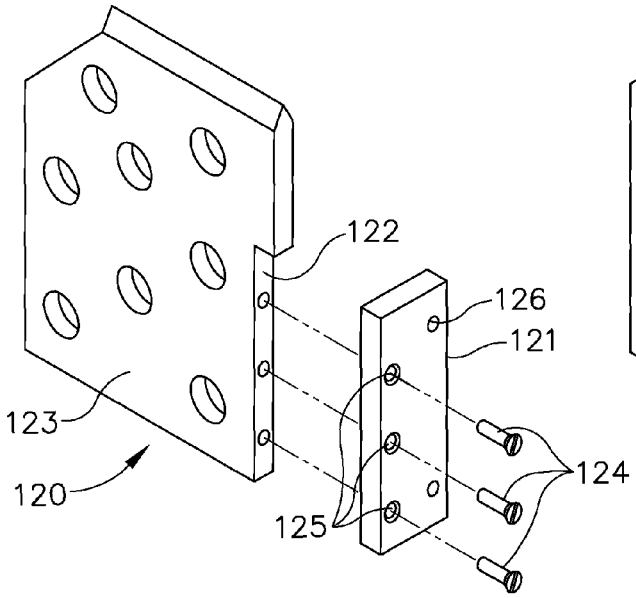
FIG. 27 is an exploded isometric view of an alternate fin and back stop construction wherein the back stop is attached to the fin rather than to the machine frame bar, and the backstop is used to secure the fin to the machine frame bar.
Figure 28:
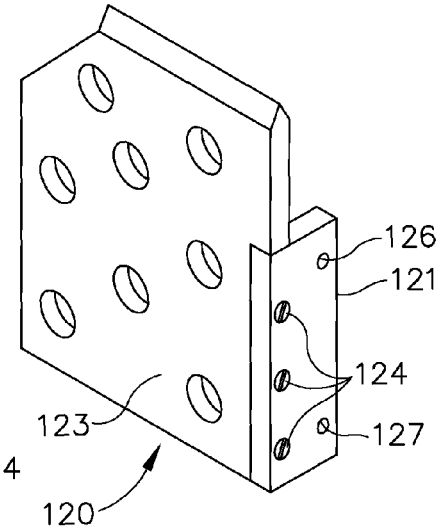
FIG. 28 is an assembled view of the fin and back stop.
Figure 29:
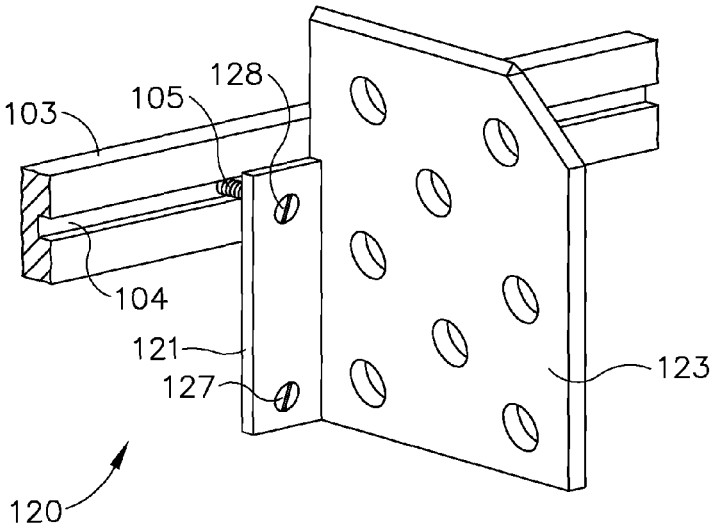
FIG. 29 shows the fin and back stop of FIGS. 27 and 28 attached to the machine frame bar.

An alternate fin and back stop assembly is shown at 120 in FIGS. 27-29. In this form of the invention the back stop 121 comprises a rectangular plate secured in a notch 122 in the back edge of the fin 123 by fasteners 124 extended through openings 125 in one edge of the plate and into the back edge of the fin so that the back stop extends at a right angle to the fin. Openings 126 and 127 are formed through the top and bottom ends, respectively, of the back stop 121 in the edge opposite the edge having the openings 125. This fin and back stop combination may be attached directly to the machine frame member 103 by extending a fastener 128 through one of the openings 126 or 127 and into a respective nut 105 in the slotted frame member 103. The back stop 121 may be positioned on the opposite side of the fin by removing the fasteners 124, inverting the back stop so that it extends from the opposite side of the fin, and reattaching the fasteners.

While particular embodiments of the invention have been illustrated and described in detail herein, it should be understood that various changes and modifications may be made in the invention without departing from the spirit and intent of the invention as defined by the appended claims.

What is claimed is:

1. A fin assembly for attachment to a die cutting machine to guide and align at least two blanks cut from a sheet in the machine as the blanks are fed through the machine, wherein the fin assembly comprises:

at least one thin plate-like fin having length and height dimensions and a narrow thickness;

at least one back stop associated with said at least one fin, and when operatively mounted in the die cutting machine said at least one back stop is adapted to prevent die-cut blanks from travelling in a reverse direction and falling out of the machine as they are fed through the machine;

an elongate mounting bar that is adapted to be attached to a frame member of the die cutting machine, and said at least one fin and said at least one back stop are attached to the mounting bar;

said at least one fin and said at least one back stop are adjustably positionable along the length of the mounting bar;

said mounting bar has top and bottom edges;

a channel extends along each of said edges; and said at least one fin and said at least one back stop each has a generally T-shaped cut-out in a back surface thereof defining opposed spaced apart parallel lips, said lips being engaged in respective said channels to hold said at least one fin and said at least one back stop against said mounting bar but permit said adjustable positioning along the length of the mounting bar; and means for mounting said at least one fin in a die cutting machine in a position so that the length dimension of said at least one fin is in substantial alignment with a respective cut separating two blanks die cut in the machine, so that the blanks fall on opposite sides of said at least one fin as they are fed through the machine, whereby said at least one fin keeps the blanks separate and aligns them as they are fed through the machine.

2. The fin assembly of claim 1, wherein:

a generally rectangularly shaped opening is formed through said at least one fin adjacent but spaced from said T-shaped cut-out, and a small opening extends between said T-shaped opening and said rectangularly shaped opening; and a set screw extends through said small opening for tightening against said mounting bar to secure said at least one fin in position on said mounting bar.

3. The fin assembly of claim 2, wherein:

said mounting bar has a front surface and a back surface; and a plurality of openings extend through said mounting bar from said front surface to said back surface; and attaching means is associated with at least one of said openings at each end of said mounting bar to secure said mounting bar to a frame member of a die cutting machine.

4. The fin assembly of claim 3, wherein:

said attaching means each comprises a mounting bracket having a substantially rectangularly shaped top wall with a front flange depending from a front edge thereof and a back flange depending from a back edge thereof, said back flange having a lip on an inner bottom edge thereof in opposed facing relation to the front flange, and said front flange having a plurality of countersunk openings therethrough; and fasteners extended through the openings in the ends of said mounting bar and into the openings in said mounting bracket front flange to secure the mounting bracket to the mounting bar, said mounting, bracket being adapted to be secured to a frame member of a die cutting machine.

5. The fin assembly of claim 4, wherein:

said at least one fin has at least one opening therethrough that functions to vent air as blanks fall past said at least one fin.

6. The fin assembly of claim 4, wherein:

said at least one back stop comprises a rectangular plate secured in a notch in a back edge of said at least one fin by fasteners extended through first openings in a first edge of the plate and into the back edge of the fin so that the back stop extends at a right angle to the fin; and second openings extend through top and bottom ends, respectively, of the back stop in a second edge opposite the first edge for receiving fasteners to secure said at least one fin and associated back stop to a frame member of a die cutting machine.

7. The fin assembly of claim 3, wherein:

said attaching means comprises a fastener extended through one of said openings in each end of said mounting bar, said fastener being adapted to be engaged with a complementary fastening means on said die cutting machine.

8. The fin assembly of claim 7, wherein:

said at least one fin has at least one opening therethrough that functions to vent air as blanks fall past said at least one fin.

9. The fin assembly of claim 7, wherein:

said at least one back stop comprises a rectangular plate secured in a notch in a back edge of said at least one fin by fasteners extended through first openings in a first edge of the plate and into the back edge of the fin so that the back stop extends at a right angle to the fin; and second openings extend through top and bottom ends, respectively, of the back stop in a second edge opposite the first edge for receiving fasteners to secure said at least one fin and associated back stop to a frame member of a die cutting machine.

10. The fin assembly of claim 1, wherein:

said at least one fin has at least one opening therethrough that functions to vent air as blanks fall past said at least one fin.

11. The fin assembly of claim 1, wherein:

said at least one back stop comprises a rectangular plate secured in a notch in a back edge of said at least one fin by fasteners extended through first openings in a first edge of the plate and into the back edge of the fin so that the back stop extends at a right angle to the fin; and second openings extend through top and bottom ends, respectively, of the back stop in a second edge opposite the first edge for receiving fasteners to secure said at least one fin and associated back stop to a frame member of a die cutting machine.

12. A fin assembly mounted in a die cutting machine to guide and align at least two blanks cut from a sheet in the machine as the blanks are fed through the machine, wherein the fin assembly comprises:

at least one fin having length and height dimensions and a narrow thickness wherein said at least one fin has at least one opening therethrough that functions to vent air as blanks fall past said at least one fin, a generally rectangularly shaped opening is formed through said at least one fin adjacent but spaced from a T-shaped cut-out, and a small opening extends between said T-shared opening and said rectangularly shaped opening, and a set screw extends through said small opening for tightening against a mounting bar to secure said at least one fin in position on said mounting bar, said mounting bar has a front surface and a back surface, and a plurality of openings extend through said mounting bar from said front surface to said back surface, attaching means each comprises a mounting bracket having a substantially rectangularly shaped top wall with a front flange depending from a front edge thereof and a back flange depending from a back edge thereof, said back flange having a lip on an inner bottom edge thereof in opposed facing relation to the front flange, and said front flange having a plurality of countersunk openings therethrough, and fasteners extended through the openings in the ends of said mounting bar and into the openings in said mounting bracket front flange to secure the mounting bracket to the mounting bar, said mounting bracket being adapted to be secured to a frame member of a die cutting machine; and attaching means is associated with at least one of said openings at each end of said mounting bar to secure said mounting bar to a frame member of a die cutting machine; and means mounting said at least one fin in the die cutting machine in a position so that the length dimension of said at least one fin is in substantial alignment with a respective cut separating two blanks die cut in the machine, so that the blanks fall on opposite sides of said at least one fin as they are fed through the machine, whereby said at least one fin keeps the blanks separate and aligns them as they are fed through the machine.

* * * * *